US005141207A

United States Patent [19]

Meglino et al.

[11] Patent Number: 5,141,207

[45] Date of Patent: Aug. 25, 1992

[54] CHAIN LINK FENCE DECORATIVE TUBING

[76] Inventors: Don Meglino; James V. Meglino, both of 100 Frank Rd., Hicksville, N.Y. 11801

[21] Appl. No.: 559,219

[22] Filed: Jun. 27, 1990

[51] Int. Cl.[5] ..... B21F 27/00

[52] U.S. Cl. ..... 256/33; 256/65; 256/19; 256/1

[58] Field of Search ..... 256/33-34, 256/1, 19, 13.1, 65; 403/23

[56] References Cited

U.S. PATENT DOCUMENTS

| | | | |
|---|---|---|---|
| 2,274,817 | 3/1942 | Zimmer | 403/23 X |
| 3,603,562 | 9/1971 | Gasmmer | 256/13.1 X |
| 4,081,941 | 4/1978 | Van Ausdall | 405/216 X |
| 4,220,316 | 9/1980 | Naka et al. | 256/1 X |
| 4,407,600 | 10/1983 | Thompson | 403/23 |
| 4,461,461 | 7/1984 | Caron | 256/65 X |
| 4,516,756 | 5/1985 | Beatty | 256/1 |
| 4,765,596 | 8/1988 | Fontana | 256/65 |
| 4,836,505 | 6/1989 | Meglino | 256/34 |
| 4,892,292 | 1/1990 | Russell | 256/19 X |

*Primary Examiner*—Andrew V. Kundrat

[57] ABSTRACT

For the cylindrical fence-supporting posts of a chain link fence, a hollow decorative plastic tube which is slidably disposed about a cooperating post and held in place by a cap which engages the top of the tube in a shoulder and is of a selected diameter to have a friction fit with the tube.

2 Claims, 2 Drawing Sheets

CHAIN LINK FENCE DECORATIVE TUBING

The present invention relates generally to slip-on decoratively colored tubes for the support post structure of chain link fence to enhance the appearance thereof, and more particularly to the facilitated placement of these tubes on the posts, but without correspondingly complicating maintaining this positioning during normal use of the fence.

EXAMPLES OF THE PRIOR ART

It is already well documented in trade literature that a chain link fence in a selected color is possible by covering the wire mesh of the fence with plastic, or with an aluminum coating, or even by embodying the wire mesh with color by galvinizing. There is no heretofore known chain link fence however, in which wire mesh supporting posts are similarly decorated with a matching or contrasting color; rather these components are usually left undecorated, which detracts from the appearance of the fence, and also subjects these components to weathering.

U.S. Pat. No. 4,516,756 issued on May 14, 1985 to Beatty, which although related to a wooden fence, is noted because the wood pickets thereof are covered, primarily for protection againt weathering by plastic sheathing which, also improves the appearance thereof. The tops of the supporting picket and cooperating sheath are of congruent shapes to maintain the sheath on the picket. If there is slip-on clearance produced by a slight oversize of the sheath relative to the picket to contribute assembly of the sheath onto the picket, which can perhaps be inferred in the disclosure of this patent, the reliance on congruent shapes will not effectively maintain the position of the sheath on the picket. On the other extreme, if there is no or little clearance so that the sheath position is maintained throughout normal use of the fence, the assembly of the sheath over and along the length of the picket is rendered correspondingly more difficult.

Broadly, it is an object of the present invention to provide slip-on decorative tubing for chain link fence overcoming the foregoing and other shortcomings of the prior art. More particularly, it is an object to readily be able to place this tubing, as decoration, in an encircling relation about the posts of a chain link fence, and in an equally simple manner maintain this positioning during normal use of the fence, all as will be explained in greater detail subsequently herein.

The description of the invention which follows, together with the accompanying drawings should not be construed as limiting the invention to the example shown and described because those skilled in the art to which this invention appertains will be able to devise other forms thereof within the ambit of the appended claims.

Figure 1:
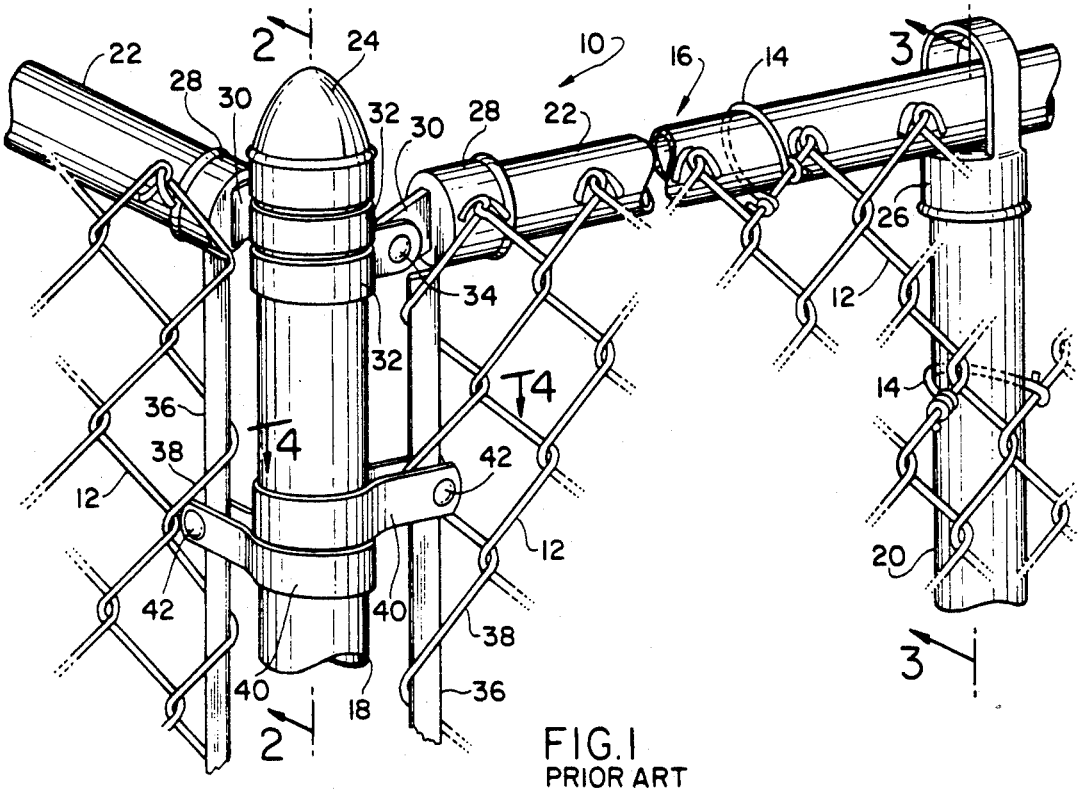
FIG.1 PRIOR ART
FIG. 1 is a perspective view of a prior art chain link fence provided for comparison to the within inventive fence.
Figure 2:
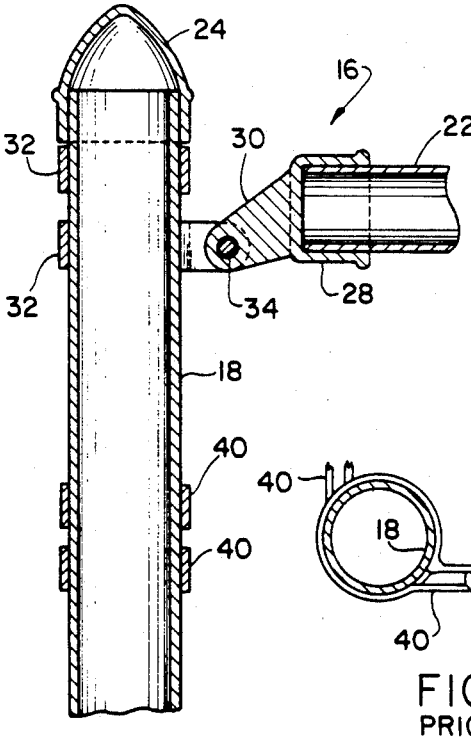
FIG.2 PRIOR ART
FIG. 2 is a sectional view as taken along line 2—2 of FIG. 1.
Figure 4:
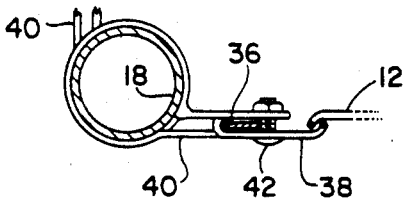
FIG.4 PRIOR ART
FIG. 4 is a sectional view as taken along line 4—4 of FIG. 1.
Figure 3:
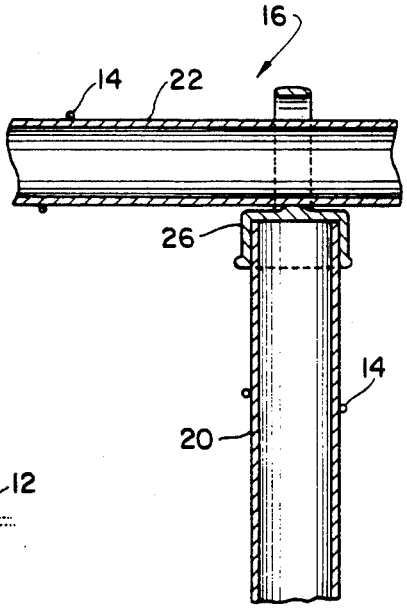
FIG.3 PRIOR ART
FIG. 3 is a sectional view as taken along line 3—3 of FIG. 1.

To better understand the within inventive improvements for decorating a fence, it is helpful to first make reference to a conventional so-called chain link fence as shown in FIG. 1. As generally understood, it includes a wire mesh 12 in a criss-crossing pattern that is suspended by aluminum tie wires 14 on a fence frame generally designated 16. Mesh 12 can be of many standard types, that might be selected from light, medium or heavy gauge steel wire covered with galvinizing, an aluminum coating or a vinyl jacketing, and is in the noted illustrated pattern or in a mesh pattern to suit the particular application. Mesh 12 is supplied in a range 3 to 6 feet in height in combination with appropriate sized posts that in use are typically planted in the ground to a depth of 2 to 2½ feet, and effectively support the mesh 12 attached in spanning relation to these posts.

Frame 16 consists principally of a group of cooperating vertically oriented end or terminal posts 18, and line posts 20, and a horizontally oriented top rail 22. Posts 18, 20 and top rail 22 are appropriately sized lengthwise according to intended end use and usually range from 1⅜" to 2½" in outside diameter. The top ends of terminal posts 18 are fitted with a flat, conical or acorn shaped cap 24. Likewise, line posts 20 are topped with a loop cap 26 which aligns and holds top rail 22. Each end of top rail 22 is fitted with a top rail cap 28 which has an offset tongue-like extension 30 which in use cooperates with brace band 32. It is to be noted that offset extension 30 allows for a pair of brace bands to hold adjacent top rails 22 in substantially the same plane when joined at a terminal post 18. A carriage bolt 34 completes the assembly of top rail cap 28 to brace band 32.

Horizontal tension on mesh 12 is maintained by inserting a tension bar 36 through each of end strands 38, as shown in FIG. 1. As part of the assembly procedure, one end tension bar 36 is made fast to a terminal post 18 by at least two tension bands 40 and bolts 42. Next, mesh 12 is made reasonably taut wherein the opposite end tension bar 36 is fastened to its respective terminal post 18 by a second set of tension bands and bolts 42. The supported attachment of mesh 12 is completed using tie wires 14 to secure mesh 12 to line posts 20.

In providing chain link fences as just described in decorative colors, such as that offered in trade literature in the colors dark green, dark brown, redwood, black and other selected colors, it has been the practice to cover the metal wire mesh fittings and bands with vinyl or other protective plastic coatings in the selected color. Solid plastic bolts and fittings have been used as well. In the drawings, the prior art FIGS. 1-4 reflect the use of all metal parts except for the mesh 12, in sharp contrast to the FIGS. 5-8 showing the present invention. Thus, coated fabric 12, filler strips, plastic hardware, are now available in an array of matching, contrasting and complimentary colors, resulting in the fence 10 being colorfully designed. However, in the prior art, top rails 22, tension bars 36, terminal posts 18 and line posts 20 have been left undecorated, detracting from the fence appearance and also subject to weathering.

In FIGS. 5–8, to which reference should now be made, the patentable advance countemplates decorating the heretofore uncovered components using decorative tubular coverings for the posts 18, 20, tension bars 36 and top rails 22. This feature allows for the design of a fence 10' that has a fully protected surface and also has color-compatability with a selected wire mesh. As will now be explained, underlying the present invention is the recognized need to allow the decorative tubes to be easily slipped over a cooperating post, and achieving the holding of the tubes in place using a cap, which on a vertically oriented post is placed on the top thereof, and on a horizontally oriented post on an end thereof, so that although the decorating tube is easily put into place as intended, it remains in its position on a cooperating supporting post.

Figure 5:
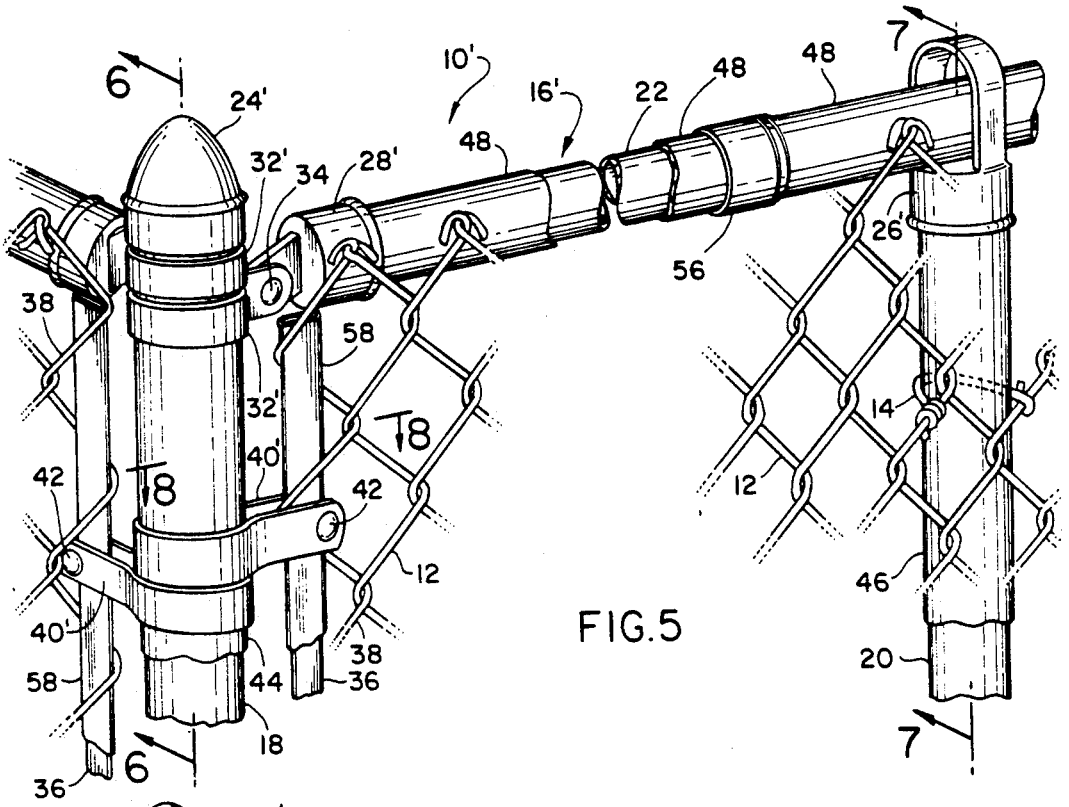
FIG. 5 is a perspective view of a chain link fence similar to FIG. 1 but illustrating a version decorated according to the present invention.

In FIG. 5 there is shown a chain link fence 10' of the present invention in which mesh 12 is suspended by tie wires 14 on a frame 16'. If mesh 12 is of the coated type then tie wires 14 will be understood to have a matching coating.

Frame 16' consists principally of end posts 18, line posts 20 and top rail 22 to each of which is added a plastic tube covering 44, 46 and 48 respectively. Coverings 44, 46 and 48 are made of an appropriate plastic to resist weathering and are slightly oversized in diameter relative to the diameter of its cooperating post to slip fit over said cooperating post of frame 16'. It is also to be noted, for a reason soon to be explained, and as examplified by the showing in FIG. 7, that decorative tube 46 which, it will be understood is preferrably fabricated as a plastic extrusion, is cut to length in preparation for its use as a decorative slip-on tube in a length that is slightly less than its cooperating post 20, thereby leaving the length difference 46A between the two lengths.

Figure 6:
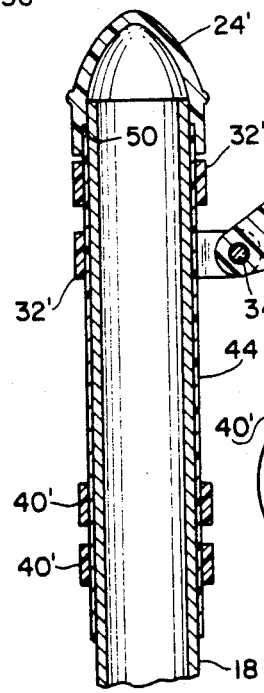
FIG. 6 is a sectional view as taken along line 6—6 of FIG. 5.
Figure 8:
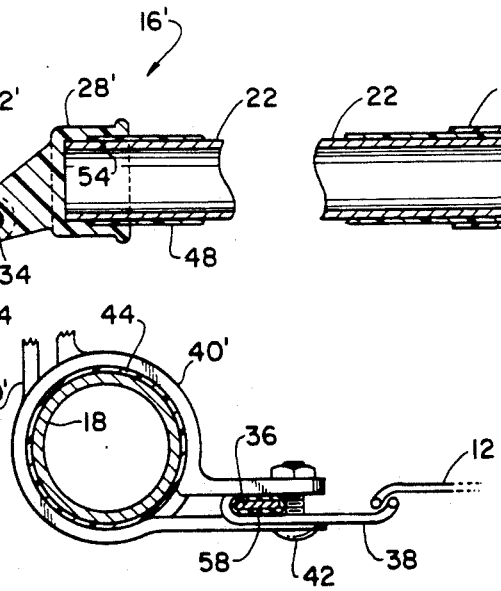
FIG. 8 is a slightly enlarged size sectional view as taken along line 8—8 of FIG. 5.
Figure 7:
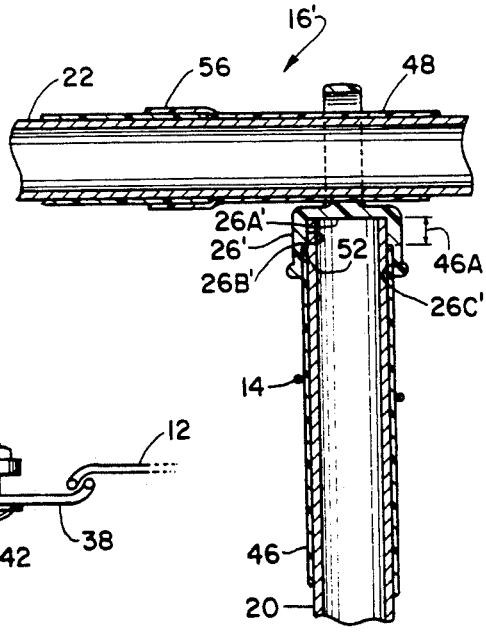
FIG. 7 is a sectional view as taken along line 7—7 of FIG. 5.

As best seen in FIGS. 6 and 7, to hold the loosely fitting tubes 44, 46 in place, use is made of post caps 24', 26' and top rail caps 28', each constructed as now will be described. Using cap 26' of FIG. 7 as the described example for all caps, said cap 26' has a closed end 26A' and is firstly formed with a bore 26B' which is of a selected size diameter to have a friction fit in area 46A that it was previously noted post 20 extends beyond its covering tube 46. Secondly, at its opening, cap 26' is formed with a counterbore 26C' starting at the end of the distance 46A which, because of the difference in diameter between the bore 26B' and counterbore 26C' results in a shoulder 52 for seating the top end of tube 46 within the cap 26'. Additionally, it is to be noted that the inside diameters of brace bands 32' and tension band 40' are increased to an appropriate extent to allow for the added thickness of tubular covering 44. While as noted the tubular coverings 44, 46 are best precut to match respective posts, the tubular coverings 48 are provided in selected lengths and assembled end-to-end using interfitting shapes, as at 56.

Tension bar 36 is also made to have a precut cover 58, which may be a flattened plastic tubing of appropriate size which slip fits over bar 36.

Assembly of fence 10' is essentially the same as fence 10 except that the tubular decorative coverings 44, 46, 48 and 58 are added in the logical sequence required. Caps 24', 26' and 28' are assembled in the usual manner while bands 32' and 40' are secured with respective bolts 34 and 42. When installed, the otherwise loosely fitting tubular coverings 44, 46, 48 and 58 remain in place, due to the friction fit at 46A established by the caps 26', 24' and 28'.

While the particular application of decoration to a chain link fence herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. Decorative tubing means for chain link fence having vertically and horizontally oriented cylindrical supporting posts of the type in which said vertically and horizontally oriented posts are of a selected length and diameter, said decorative tubing means for said one cooperating vertically and horizontally oriented post comprising a circular extrusion of plastic construction material of a selected diameter slightly greater than the diameter of said one cooperating post and cut to a length which is a selected size slightly less than the length of said post, said extrusion being provided with an operative position in covering relation over said one cooperating post facilitated by a sliding clearance resulting from the slight oversize in diameter of said extrusion in relation to said post, and a closed end hollow cap having an inner cylindrical wall bounding an opening thereinto, said cylindrical wall being firstly formed with a closed end in a diameter selected to have a friction fit with said post when said cap is in an operative position on top of said post and said cylindrical wall is in contact against said post in the area adjacent the top thereof and secondly formed with a counterbore adjacent said opening starting at a distance from said cap closed end which is substantially of the same distance said posts extends beyond said extrusion so that the difference between the diameters of said bore and counterbore form a shoulder serving as a seat for the end of said extrusion, whereby said operative position of said cap in providing said friction fit holds said extrusion in place in covering relation over said cooperating post and also in its seated position against said cap shoulder.

2. Decorative tubing means for chain link fence supporting posts as claimed in claim fabricated of plastic construction material of a selected color, to thereby enhance the appearance of said chain link fence by the display of said selected color.

* * * * *